United States Patent [19]

Kupperman et al.

[11] 4,195,707

[45] Apr. 1, 1980

[54] COMMUNICATING DEVICE

[75] Inventors: Sam Kupperman, Chicago; Dennis Kupperman, Glenview, both of Ill.

[73] Assignee: RB Toy Development Co., Skokie, Ill.

[21] Appl. No.: 878,674

[22] Filed: Feb. 17, 1978

[51] Int. Cl.[2] ..... G08B 1/00

[52] U.S. Cl. ..... 181/138

[58] Field of Search ..... 181/138, 162; 46/33

[56] References Cited

U.S. PATENT DOCUMENTS 3,082,838 3/1963 Gajdosik ..... 181/138

*Primary Examiner*—Stephen J. Tomsky

*Attorney, Agent, or Firm*—Vogel, Dithmar, Stotland, Stratman & Levy

[57] ABSTRACT

A device for communicating in which a hollow frustum extending outwardly from a flat base has tabs at the ends thereof for holding a relatively rigid diaphragm having spaced apart apertures therein. A pair of these devices are interconnected by a cord or string, whereby conversation or sound projected into one of the devices is reproduced at the other device. Two devices are molded as a single integral unit and merchandised as an in-pack item with children's breakfast cereals.

9 Claims, 8 Drawing Figures

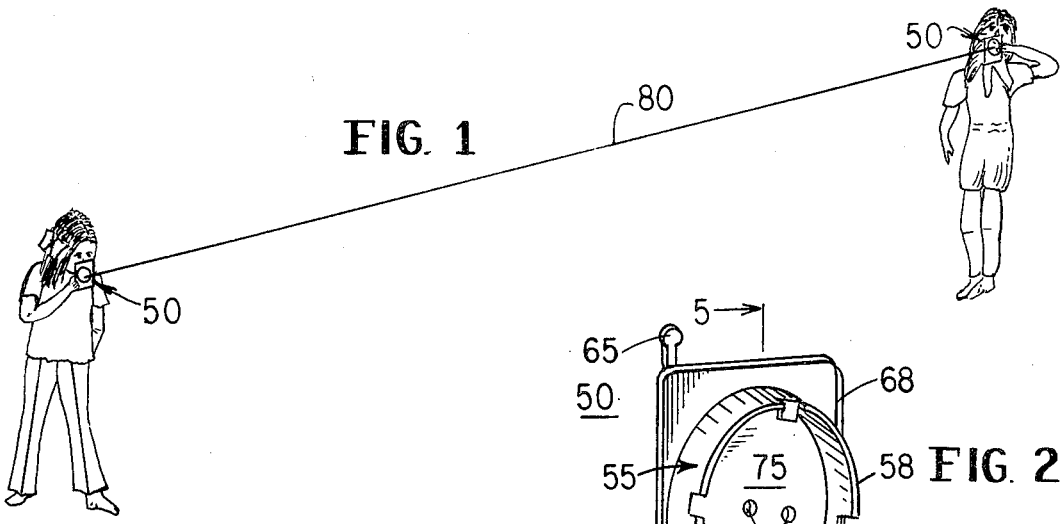
FIG. 1
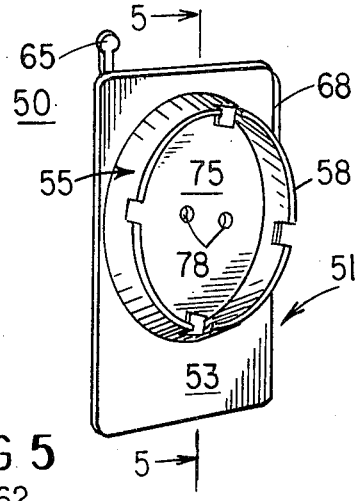
FIG. 2
FIG. 3
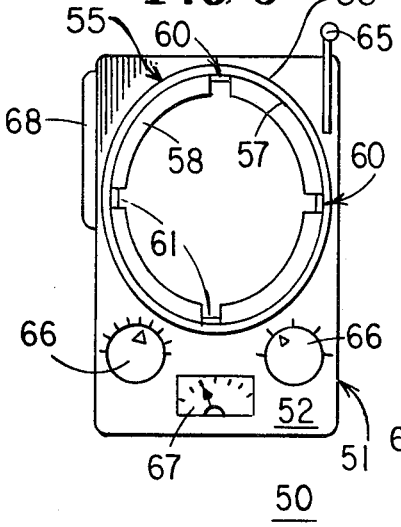
FIG. 4
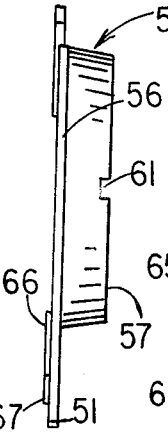
FIG 5
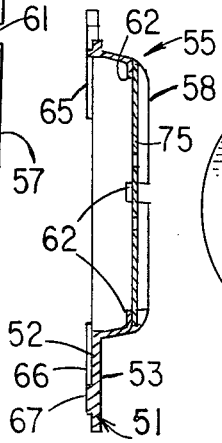
FIG. 6
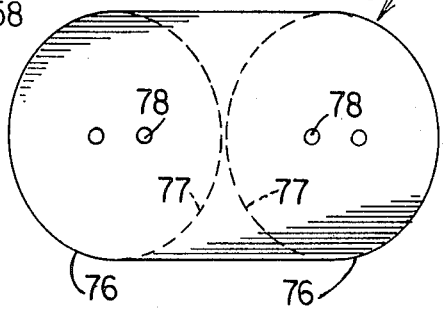
FIG. 7
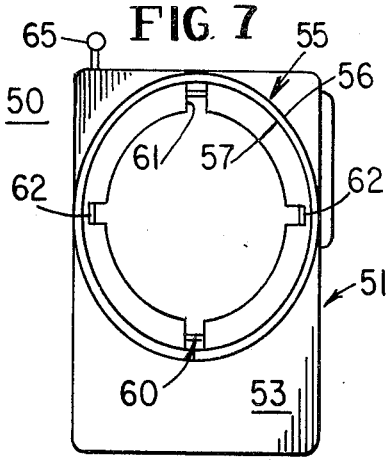
FIG. 8
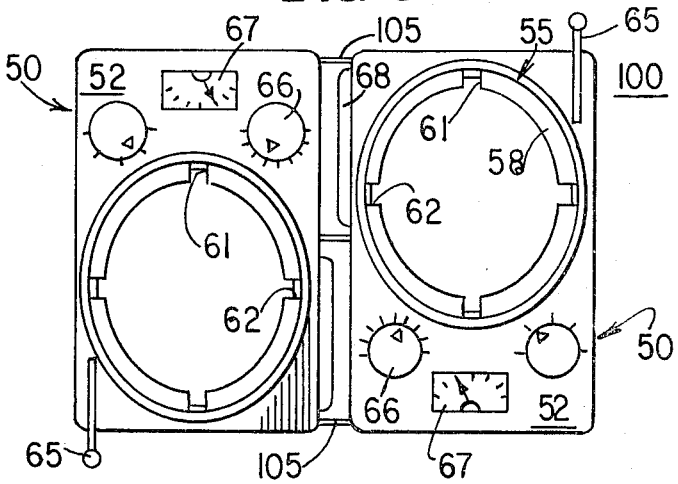

COMMUNICATING DEVICE

BACKGROUND OF THE INVENTION AND PRIOR ART DISCLOSURE

Communicating devices such as walkie talkies for children are notoriously old, and in fact, paper cups interconnected by strings have been used by children for many years. Battery operated walkie talkies are sold at children's toy stores and are available in several varieties. The problem exists, however, when a walkie talkie is to be designed for use as an in-pack item included with breakfast cereal foods. An item for use as an in-pack must be inexpensive, small and light weight, yet at the same time capable of being easily assembled into the end product. Therefore, battery operated devices are certainly not acceptable as an in-pack item and bulky devices such as the traditional paper cups are also not acceptable.

SUMMARY OF THE INVENTION

This invention relates to a light weight device easily constructed into a walkie talkie, and more particularly, to a device in which a relatively rigid diaphragm is resiliently held in a flat base to provide the essential part of the walkie talkie device.

An important object of the present invention is to provide a molded piece of plastic which is capable of being constructed into two walkie talkies which when interconnected by a string will function to transmit sound from one walkie talkie to the other.

An important object of the present invention is to provide a device for communicating comprising a flat base, a hollow frustum extending outwardly away from the base, resilient retaining means at the smaller end of the frustum, a diaphragm complementary in shape to the smaller end of the frustum and resiliently held thereagainst by the retaining means, and means for connecting a string between a pair of the diaphragms, whereby when a string between two diaphragms is under tension conversation into one device is transmitted via the string to the other device.

These and other objects of the present invention may be more readily understood by reference to the following specification taken in conjunction with the accompanying drawings, in which:

BRIEF DESCRIPTION OF THE DRAWINGS

FIG. 1 is a perspective view of two children using the walkie talkie or communicating device of the present invention;

FIG. 2 is a rear elevational view in perspective of the inventive device;

FIG. 3 is a front elevational view of the device illustrated in FIG. 2;

FIG. 4 is a side elevational view of the device shown in FIG. 3;

FIG. 5 is a view in section of the device illustrated in FIG. 2 as seen along line 5—5 thereof;

FIG. 6 is an elevational view of the die cut diaphragms for use with the subject invention;

FIG. 7 is a rear elevational view of the device illustrated in FIG. 2; and FIG. 8 is a pair of devices in the as molded condition thereof.

DESCRIPTION OF THE PREFERRED EMBODIMENT

As shown in the drawings, the communicating device 50 is comprised of a flat base 51 generally rectangular in plan view having a front surface 52 and a rear surface 53. Integral with the base 51 and extending outwardly from the rear surface 53 thereof is a frustum 55 having a large oval-shaped end 56 and a small oval-shaped end 57. The distal small oval shaped end 57 of the frustum 55 is inwardly turned forming a flange 58 having an effective diameter slightly smaller than the end 57 of the frustum, see FIG. 5.

Equidistantly spaced around the peripheral flange 58 at the end of the frustum 55 are four retaining means 60 each in the form of a tab 62 facing the flange 58 and defining an undercut 61 therebetween. The tabs 62 are near the flange 58 at the end 57 of the frustum 55, for a purpose hereinafter set forth.

On the front surface 52 of the base 51 is a simulated aerial 65 extending upwardly beyond the peripheral edge of the base 51 and spaced apart dials 66 positioned beneath the large end 56 of the frustum 55. Intermediate the dials 66 is a simulated meter 67 and a simulated push-to-talk button 68 extends outwardly beyond the peripheral edge of the base 51 in the upper left-hand corner thereof, as seen in FIG. 3.

Two diaphragms 75 are provided in a single card with the shape of the diaphragms being formed by the outer periphery 66 of the card in combination with the perforated lines 77 forming the remainder of the diaphragm edges. Each diaphragm 75 is provided with two spaced apart apertures 78 substantially centrally located, for a purpose to be explained. One of the diaphragms 75 is mounted in each of the devices 50 and snap fits into the frustum 55 and is maintained therein by the coaction of the tab 62 and the flange 58. As seen particularly in FIG. 5, the proximity of each of the tabs 62 to the flange 58 maintains the diaphragm 75 in contact with the flange at the small end of the frustum 55. After two of the devices 50 have been assembled, a string 80 is passed through one of the apertures 78 from the rear of the diaphragm 75, looped around the front of the diaphragm and through the other aperture and tied in a conventinal knot so that two users, as illustrated in FIG. 1, may use the combined devices as shown to talk one with the other. This method permits small children to assemble the toy, since the difficult to tie sewing knot is unnecessary.

The devices 50 when included in a cereal package as an in-pack item appear as shown in FIG. 8 as a molded unit 100 in which two devices 50 are connected by spaced apart sprues 105, three being shown to connect the two bases 51. As seen, the bases are up-side-down orinverted, with respect to each other so that the aerials 65 extend away from each other and the simulated press-to-talk buttons 68 face each other in a nesting relationship. This configuration is the most advantageous for molding and for shipping in cereal packages.

The preferred materials for use in the present invention are polypropylene for the device 50 and relatively stiff cardboard for the diaphragm 75. Other materials acceptable for the device 50, include a high density polyethylene and polystyrene, whereas acceptable materials for the diaphragm would be a thin synthetic organic resin of the same type used for the device 50. Common household string is acceptable to interconnect the two devices 50 in use. Generally, when molding the two devices 50 as a unit 100, it is desirable to have them as close as possible and yet still retain clearance for the mold to reject a piece, and accordingly, the preferred length of the sprues 105 is ⅛". These sprues 105 should be of reduced diameter to facilitate easy removal of the sprues by the user of the toy.

A feature of the present invention is the inexpensive cost, the light weight and small size as well as the easy to use method of operation. Even small children can assemble the device 50 and use it successfully, since no complicated knots or connections are required between the diaphragm 75. Although a frustum 55 oval in transverse cross section has been shown, it will be understood and appreciated that the frustum 55 may be circular in transverse cross section, or elliptical or rectangular, the exact shape being a matter of choice. It is intended that the term "frustum" cover all the above. Additionally, the depth of the frustum 55 may vary according to design choice from 1/32 inch to ½ inch, with the greater depth being preferred.

While there has been illustrated what at present is considered to be the preferred embodiment of the present invention, it will be understood that various modifications and alterations may be made therein without departing from the true spirit and scope of the present invention and it is intended to cover in the appended claims all such variations and modifications therein.

What is claimed is:

1. A device for communicating comprising a flat base and a hollow frustum integral therewith and extending outwardly therefrom, retaining means at the smaller end of said frustum, a discrete diaphragm complementary in shape to said smaller end of said frustum and held thereagainst by said retaining means, and means for connecting a string between a pair of said diaphragms, whereby when a string between two diaphragms is under tension conversation into one device is transmitted via the string to the other device.

2. The device set forth in claim 1, wherein the intersection between said base and said frustum is oval.

3. The device set forth in claim 1, wherein said resilient retaining means includes an inwardly facing flange at the smaller end of said frustum with a plurality of tabs spaced therefrom and integral therewith.

4. The device set forth in claim 3, wherein there are tabs spaced equidistantly around the periphery of said flange and spaced therefrom to define four undercuts therebetween.

5. The device set forth in claim 1, wherein said connecting means is spaced apart apertures in said diaphragm.

6. The device set forth in claim 1, wherein said base is a synthetic organic resin.

7. The device set forth in claim 6, wherein said resin is polypropylene.

8. The device set forth in claim 6, wherein the diaphragm is a rigid paper.

9. The device set forth in claim 6, wherein the diaphragm is a rigid synthetic organic resin.

* * * * *

UNITED STATES PATENT AND TRADEMARK OFFICE

CERTIFICATE OF CORRECTION

PATENT NO. : 4,195,707

DATED : April 1, 1980

INVENTOR(S) : SAM and DENNIS KUPPERMAN

It is certified that error appears in the above-identified patent and that said Letters Patent are hereby corrected as shown below:

Column 2, line 36, after "the" insert --undercut 61 of the--;
line 45, "conventinal" should be --conventional--.
Column 4, lines 2 and 3, after "diaphragm" delete "complementary in shape to" and insert --having a diameter larger than the diameter of--.

Signed and Sealed this

*Tenth* Day of *June 1980*

[SEAL]

*Attest:*

SIDNEY A. DIAMOND

*Attesting Officer*

*Commissioner of Patents and Trademarks*